US006308009B1

(12) United States Patent
Shellenberger et al.

(10) Patent No.: US 6,308,009 B1
(45) **Date of Patent: *Oct. 23, 2001**

(54) ELECTRIC WATER HEATER WITH ELECTRONIC CONTROL

(75) Inventors: Timothy J. Shellenberger, Johnson City; Anthony Krell, Jonesborough, both of TN (US)

(73) Assignee: American Water Heater Company, Johnson City, TN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/090,532

(22) Filed: Jun. 4, 1998

(51) Int. Cl.[7] ..... F24H 1/20; H05B 3/78
(52) U.S. Cl. ..... 392/454; 392/463
(58) Field of Search ..... 392/449, 451, 392/454.5, 497.8, 500.01

(56) References Cited

U.S. PATENT DOCUMENTS

| | | | | |
|---|---|---|---|---|
| 3,781,839 | | 12/1973 | Clifford . | |
| 3,909,588 | | 9/1975 | Walker et al. . | |
| 3,952,182 | | 4/1976 | Flanders . | |
| 4,535,931 | | 8/1985 | Bartok et al. . | |
| 4,638,147 | | 1/1987 | Dytch et al. . | |
| 5,103,078 | * | 4/1992 | Boykin et al. | 219/494 |
| 5,168,546 | * | 12/1992 | Laperriere et al. | 392/454 |
| 5,377,299 | | 12/1994 | Anson et al. . | |
| 5,442,157 | * | 8/1995 | Jackson et al. | 219/492 |
| 5,504,306 | | 4/1996 | Russell et al. . | |
| 5,586,214 | * | 12/1996 | Eckman | 392/503 |
| 5,692,096 | | 11/1997 | Massey et al. . | |
| 5,706,390 | | 1/1998 | O'Neil . | |
| 5,797,358 | | 8/1998 | Brandt et al. . | |
| 5,808,277 | * | 9/1998 | Dosani et al. | 219/481 |

* cited by examiner

*Primary Examiner*—Teresa Walberg
*Assistant Examiner*—Thor Campbell
(74) *Attorney, Agent, or Firm*—Schnader Harrison Segal & Lewis LLP

(57) ABSTRACT

A water heater has a water container and an element located to heat water in the water container. A sensor located to sense temperature proximate the element and a controller connected to the element and the sensor. The controller is programmed to compare a plurality of sensed temperatures and to disengage the element in the event that the difference between sensed temperatures over a predetermined time period is greater than a predetermined temperature difference and further to engage the element based on a comparison of sensed tempereatures.

22 Claims, 8 Drawing Sheets

ELECTRIC WATER HEATER WITH ELECTRONIC CONTROL

FIELD OF THE INVENTION

This invention relates to an electric water heater, particularly to an electric water heater having an electronic control system that greatly improves manufacturing costs, reduces warranty expense and operating efficiencies.

BACKGROUND OF THE INVENTION

Typical electric water heaters are constructed with one or two electric-powered heating elements to heat water in the water tank, depending on the size and utilization of the water heater. Each element utilizes an electromechanical thermostat mounted onto the side of the tank at the point where the screw cap of the element connects to the side of the water tank. There are a number of disadvantages associated with such constructions.

Current electromechanical thermostats use bimetal technology for actuation of a set of contacts that either energize or deenergize the heating element. Such bimetal technology is comparatively imprecise and the response time to temperature changes in the water tank are relatively slow, thereby reducing water heater efficiency.

Another significant problem with present construction is the difficulty of protecting against "dry fired" elements. "Dry fire" occurs when power is applied to a heating element without water surrounding the element. Such dry firing rapidly causes damage to the heating element, thereby sharply reducing its useful life span. In most instances, dry firing can cause immediate failure of the element.

Current electromechanical thermostats also utilize a comparatively large and bulky thermostat bracket and occupy a comparatively large amount of surface area on the side of the water tank. This reduces energy efficiency since polyurethane foam insulation that surrounds the remainder of the tank is not used in this space. This occurs because the chemicals that form the polyurethane foam can interfere with the electromechanical thermostat controls during assembly and field service. Current methods for preventing such interference include foaming aprons, fiberglass batts or EPS foam dams, all of which have lower thermal efficiency (K-factors) than the polyurethane foam surrounding the remainder of the tank.

All of the above constructions result in a large number of manufacturing parts and steps, all of which add to the final cost of the product.

OBJECTS OF THE INVENTION

It is an object of the invention to provide a water heater that increases energy efficiency.

It is another object of the invention to provide a water heater that eliminates comparatively large electromechanical thermostats and reduces the number of component parts required to produce a water heater.

It is yet another object of the invention to provide a water heater that protects against dry firing of heating elements.

Other objects and advantages of the invention will become apparent to those skilled in the art from the drawings, the detailed description of the invention and the appended claims.

SUMMARY OF THE INVENTION

In one aspect, the water heater of the invention includes a water container; an element located to heat water in the water container; a sensor located to sense temperature proximate the element; and a controller connected to the element and the sensor, the controller being capable of disengaging the element in the event that a sensed temperature over a predetermined time interval is greater than a predetermined temperature difference, wherein there is substantially no degradation of the element within the predetermined time interval.

In another aspect of the invention, there is a water heater that includes a water container; an element located to heat water in the water container; a sensor located to sense temperature of water in the water container; and a controller connected to the element and the sensor, the controller being capable of comparing temperature information received from the sensor with a predetermined temperature and energizing the element based on the comparison.

DETAILED DESCRIPTION OF THE INVENTION

Figure 2:
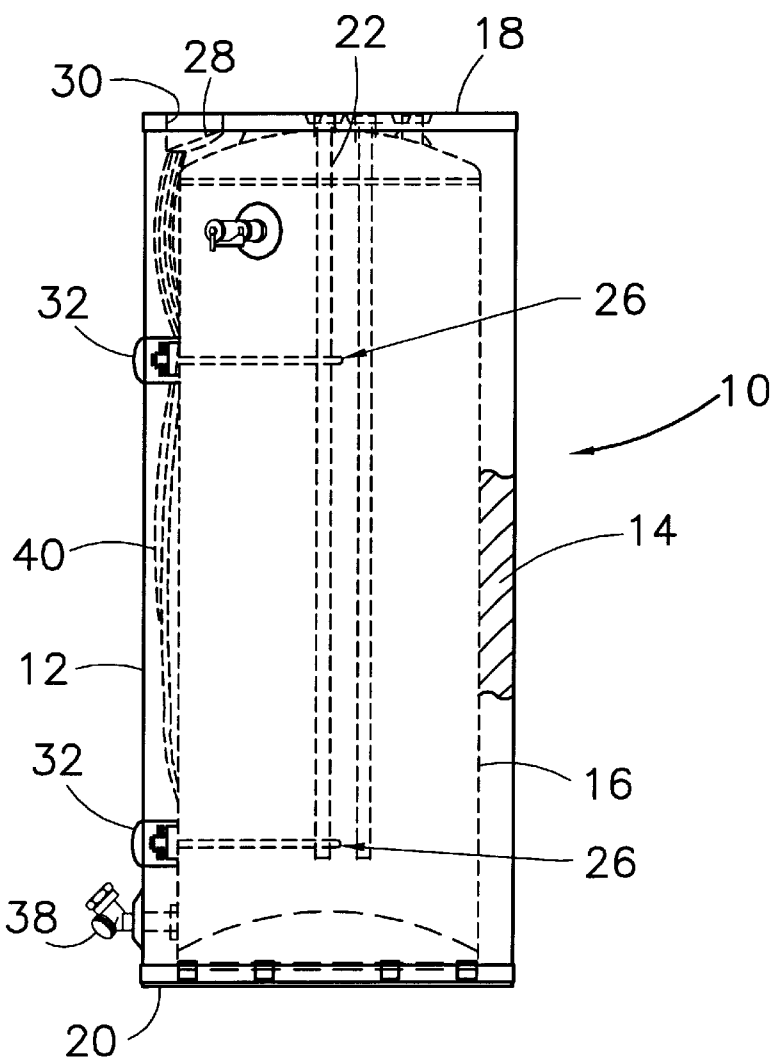
FIG. 2 shows a schematic side elevational view, taken partly in section, of the water heater of FIG. 1.
Figure 1:
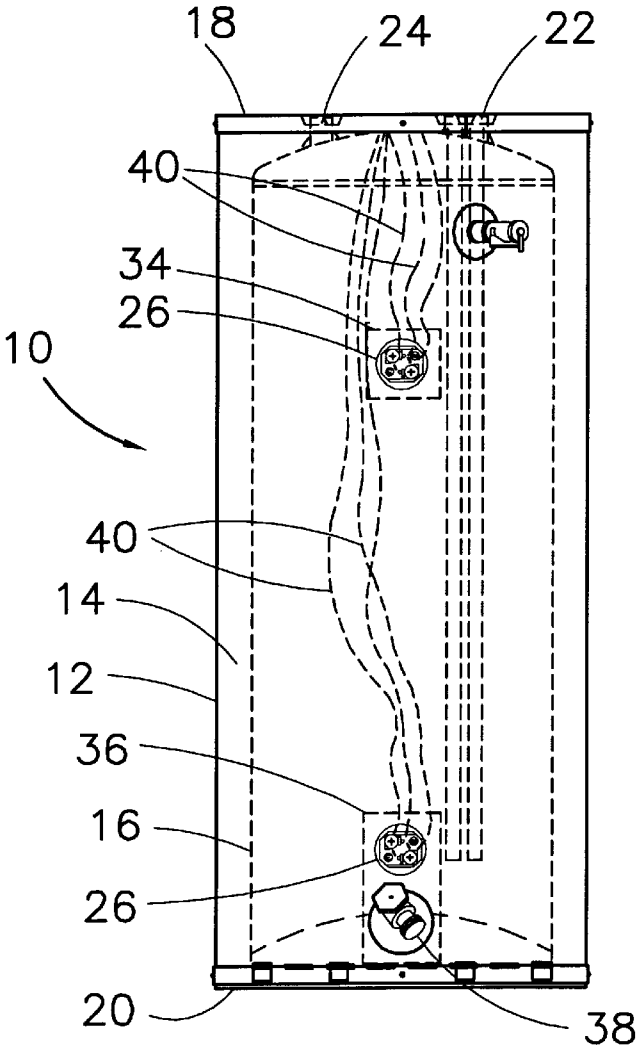
FIG. 1 shows a schematic front elevational view of a water heater in accordance with aspects of the invention wherein dashed lines show interior portions of the water heater.
Figure 3:
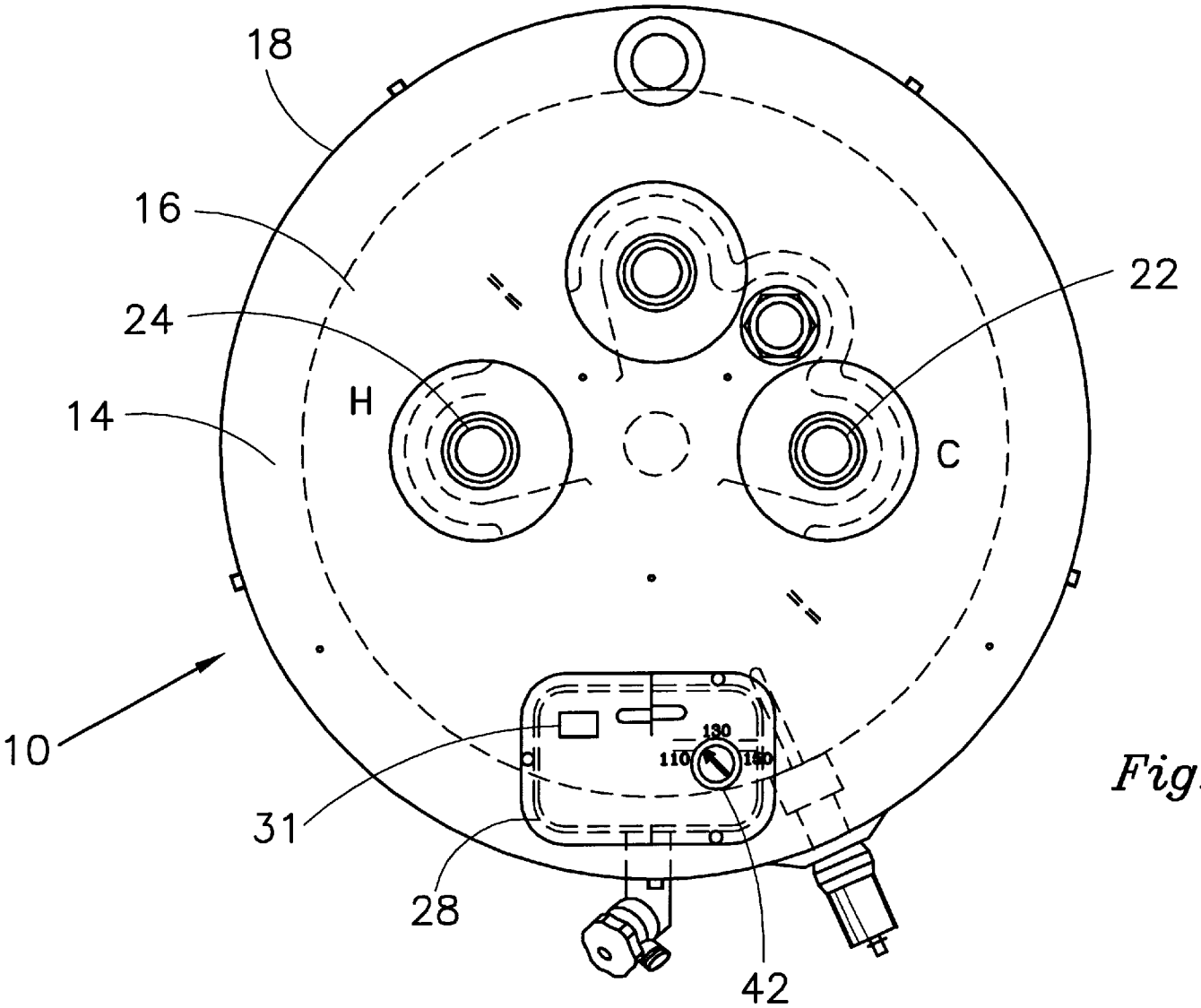
FIG. 3 shows a schematic exploded top view of the water heater shown in FIG. 1 and a user interface.
Figure 4A:
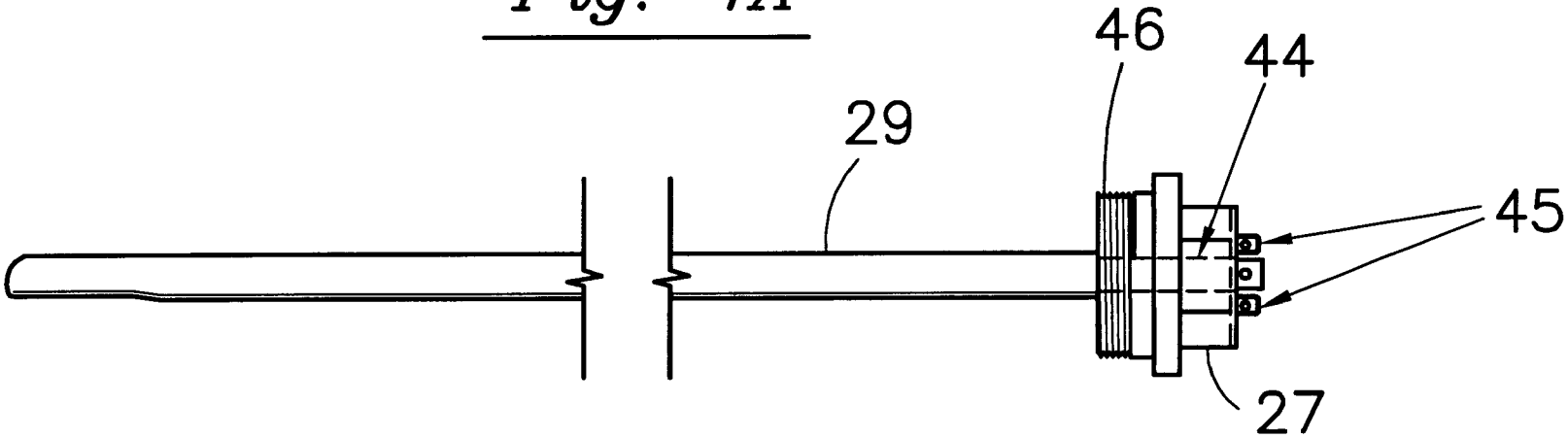
FIGS. 4A and 4B show side and front elevational views, respectively, of a heating element utilized in accordance with aspects of the invention.
Figure 4B:
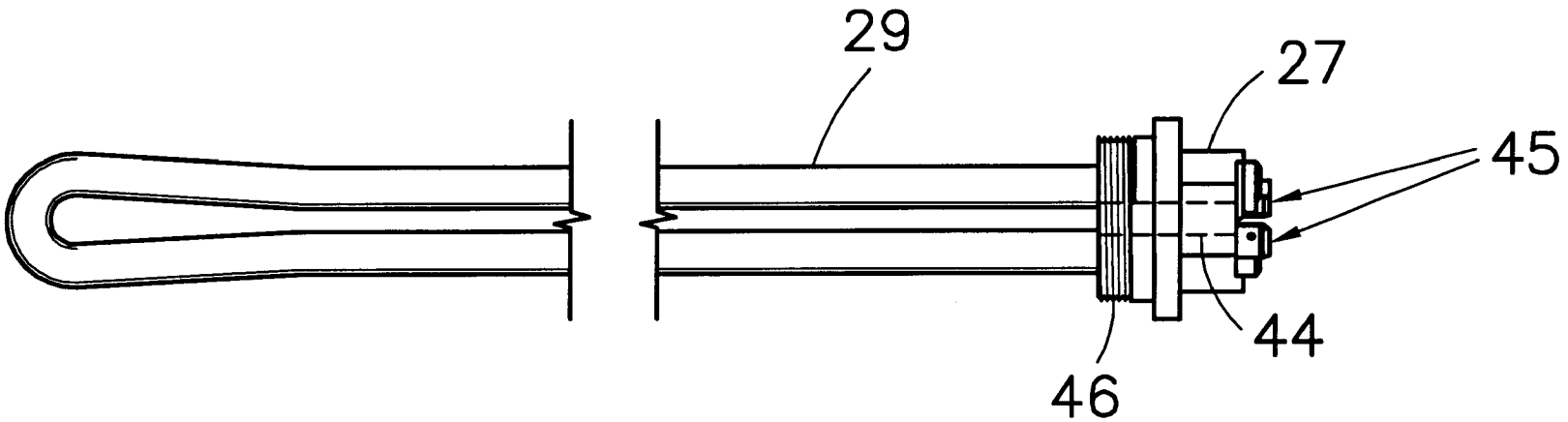

It will be appreciated that the following description is intended to refer to the specific embodiments of the invention selected for illustration in the drawings and is not intended to define or limit the invention, other than in the appended claims.

Turning now to the drawings in general and FIGS. 1–4B in particular, the number "10" designates an electric water heater of the invention. Water heater 10 includes an outer jacket 12 which surrounds foam insulation 14. Foam insulation 14 surrounds water tank 16. A top pan 18 caps jacket 12 on its upper end and bottom pan 20 caps jacket 12 on its lower end. An inlet 22 in the upper portion of tank 16 provides for cold water to enter the tank. Similarly, outlet 24 allows for hot water to exit through the upper portion of tank 16.

A pair of heating elements 26 are mounted to the side of tank 16. Elements 26 are electrically connected to an electronic controller 28 located in a recessed portion 30 of top pan 18. Elements 26 are mounted to the side wall of tank 16 by means well known to those of ordinary skill in the art, such as threads 46, and are covered by plastic caps 32 which snap into position through openings in jacket 12. An upper foam dam 34 surrounds upper element 26 and extends between tank 16 and jacket 12. Similarly, lower foam dam 36 surrounds element 26 and spigot 38. Foam dam 36 also extends between jacket 12 and tank 16.

Each heating element 26 includes a base 27, a resistance heater 29, a thermistor sensor 44 and a pair of thermistor connectors 45. The thermistor 44 is embedded in base 27 between opposing legs of the resistance heater 29.

Electronic controller 28 connects to elements 26 by way of wires 40. Wires 40 extend between electronic controller 28 and elements 26 through the space between jacket 12 and tank 16. That space is otherwise filled with insulation 14. It is possible for wires 40 to be located such that foam-forming liquids form directly around wires 40 during the foaming process. Also, wires 40 can be located within a passageway created within the foam, if desired, such as with tubes, pipes and the like. Electronic controller 28 is a user interface and includes a water temperature adjustment dial 42 which can be rotated to select a variety of water temperatures at which the water within tank 16 will be maintained.

Figure 5:
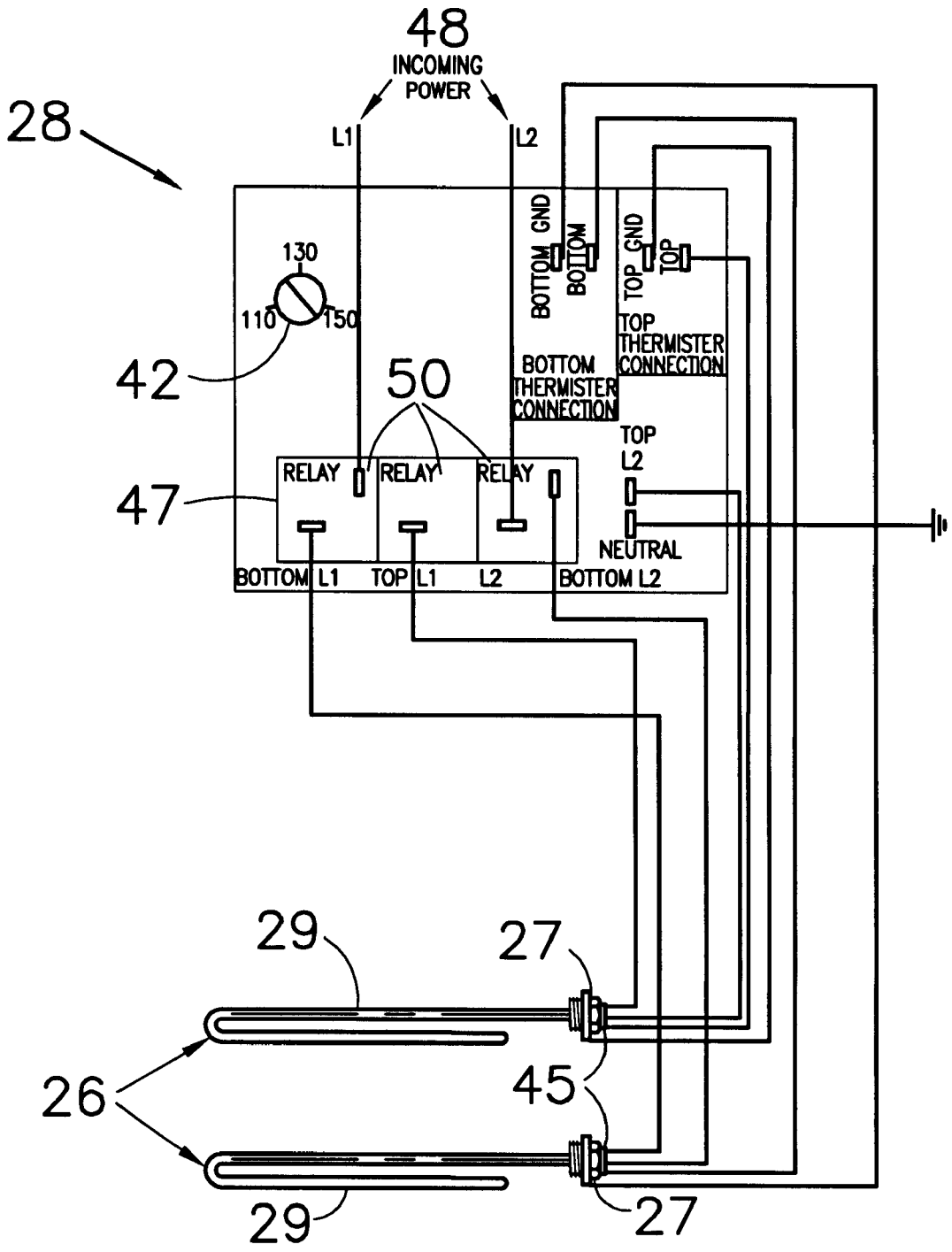
FIG. 5 discloses a circuit diagram of the control system of a water heater in accordance with aspects of the invention.
Figure 6:
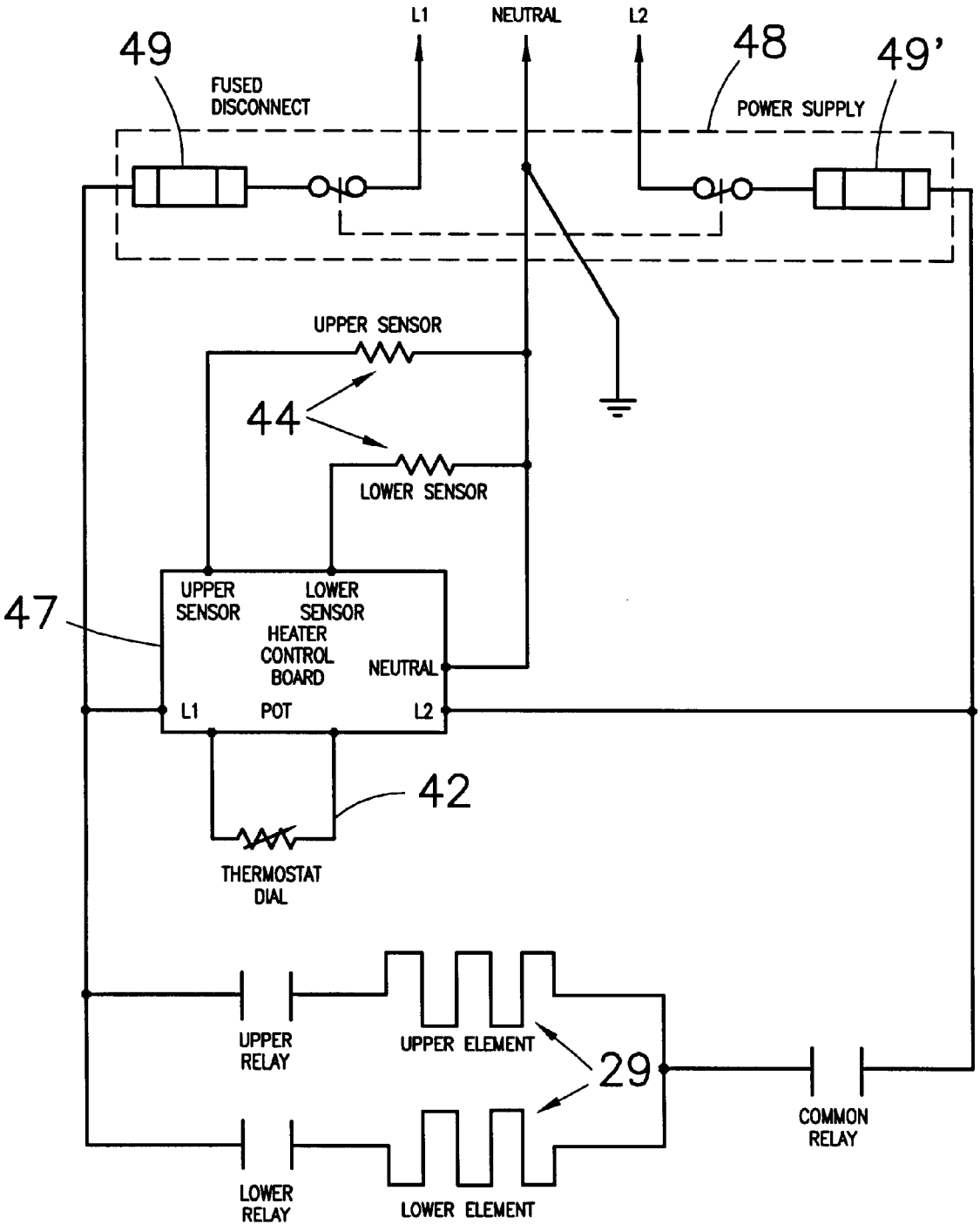
FIG. 6 shows a ladder diagram of the control system of a water heater in accordance with aspects of the invention.

The specifics of the connections and operations of electronic controller 28 and heating elements 26 shown in FIGS. 5 and 6. Thermistor 44 is connected in a conventional manner through thermistor connectors 45 to electronic controller 28. Resistance heater 29 is also connected to heater control board 47 via relays 50 on heater control board 47. Electrical power is supplied to the system through power supply 48, which include fuses 49 and 49' for deenergizing the system in the event of an amperage surge.

Heater control board 47 preferably incorporates electronic control circuitry for controlling operation of the water heater, as described in more detail below. Such control circuitry may incorporate a number of electronic components, known to those of ordinary skill in the art, such as solid state transistors and accompanying biasing components, or one or more equivalent, programmable logic chips. The electronic control circuitry may also incorporate a programmable read only memory (PROM), random access memory (RAM) and a microprocessor.

The arrangement and/or programming of these components may take any number of forms well known to those of ordinary skill in the art to accomplish operation of the water heater as described below. For example, specific programming of the type described herein may be obtained from Therm-O-Disc, Inc. and United Technologies Electronic Controls.

When there is a call for hot water, hot water exits through outlet 24 and cold water is introduced through inlet 22. Thermistor sensors 44 detect the temperature of water within tank 16 by way of their being embedded in bases 27 at positions interior of the water tank side wall. The temperatures of bases 27 reflect the temperature of water in tank 16. Thermistors 44 then send temperature information, typically in the form of an electrical signal, to controller 28. Controller 28 is programmed with predetermined set point temperatures to determine the temperature at which controller 28 energizes element 26. The predetermined set point can be made to be variable if desired. When the temperature of the water within tank 16 decreases to that predetermined set point, controller 28 detects such temperature information received from thermistor sensor 44 and energizes element 26. Element 26 continues in the energized state to heat the water until temperature information received from sensor 44 indicates that the water temperature has reached a second predetermined set point.

The second predetermined set point can be selected by adjustment dial 42 and is variable. When controller 28 detects that the second predetermined set point has been reached, controller 28 deenergizes element 26. The second predetermined set point typically has five variable settings for deenergizing elements 26. Such selectable settings are preferably between about 90° F.–180° F. The differential for energizing the elements can vary depending on the task to be performed.

Controller 28 also contains a lock-out set point which is preferably less than about 210° F. The control lock-out prevents elements 26 from energizing when the water temperature reaches an abnormal predetermined set point and the controller 28 will not permit energizing of elements 26 until controller 28 is reset by removing power and then subsequently reapplying power. This can be accomplished automatically by controller 28, thereby reducing and possibly eliminating the need for a mechanical reset control. Such a reset could be performed by a reset user interface 31 on controller 28. The sensing capabilities of sensors 44 are such that elements 26 can be energized and deenergized after only approximately 1.5 gallons of water have been drawn from tank 16. This compares to about 3.0 gallons of water removal in prior art constructions.

Figures 1, 7:
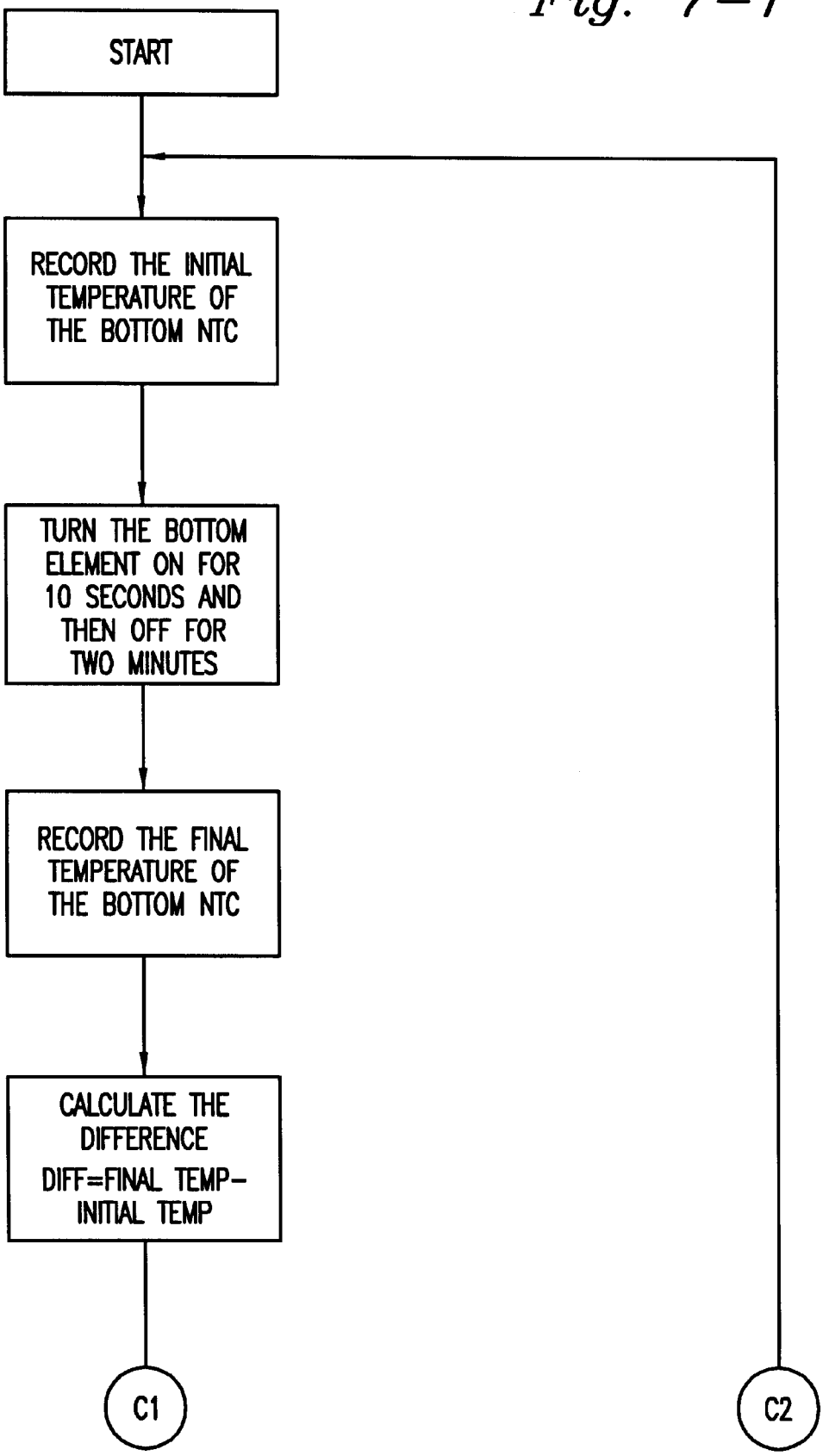
FIG. 7 shows a simplified functional block diagram illustrating the function of prevention of dry fire in heating elements in accordance with aspects of the invention.
Figures 2, 7:
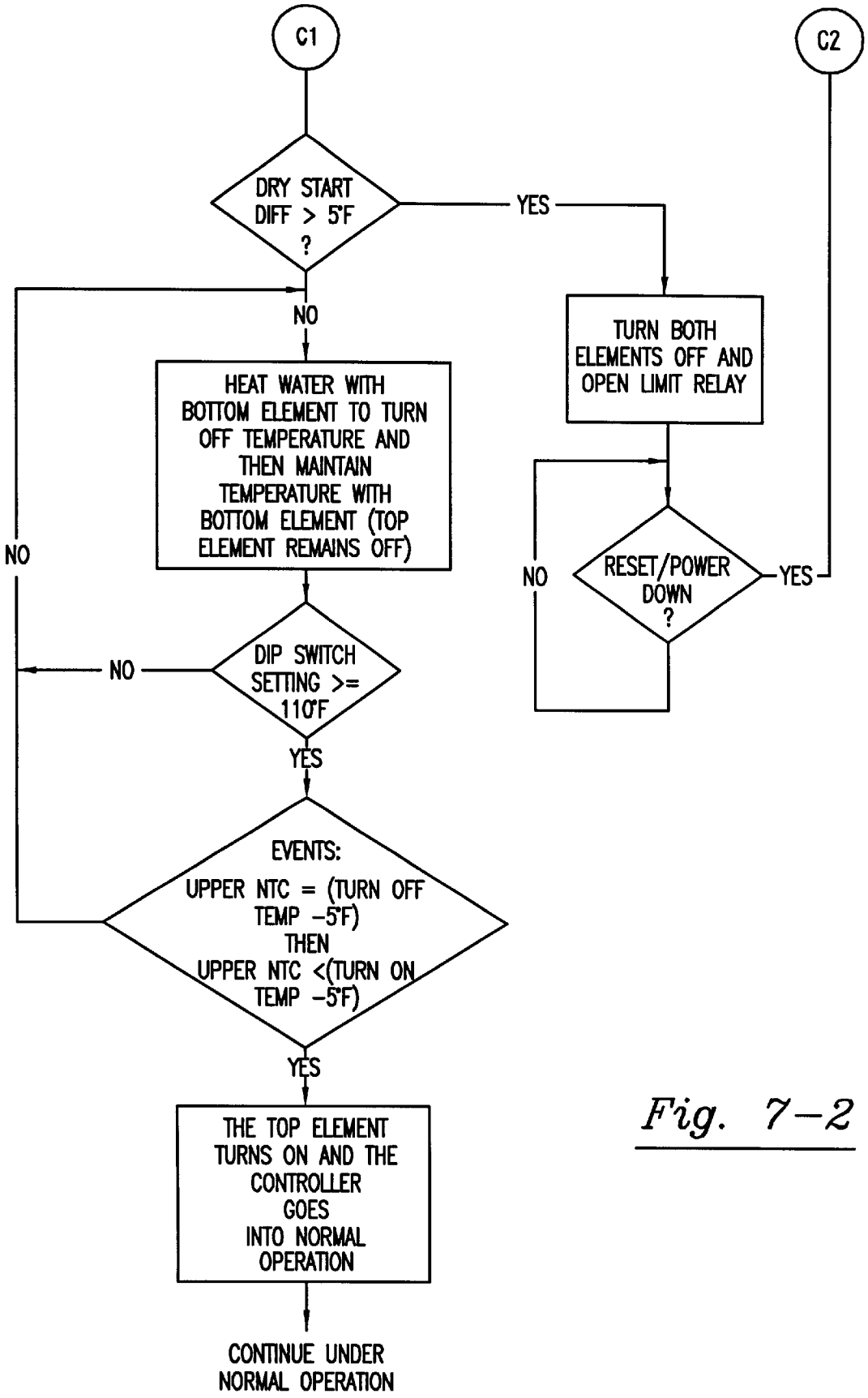
Figure 8:
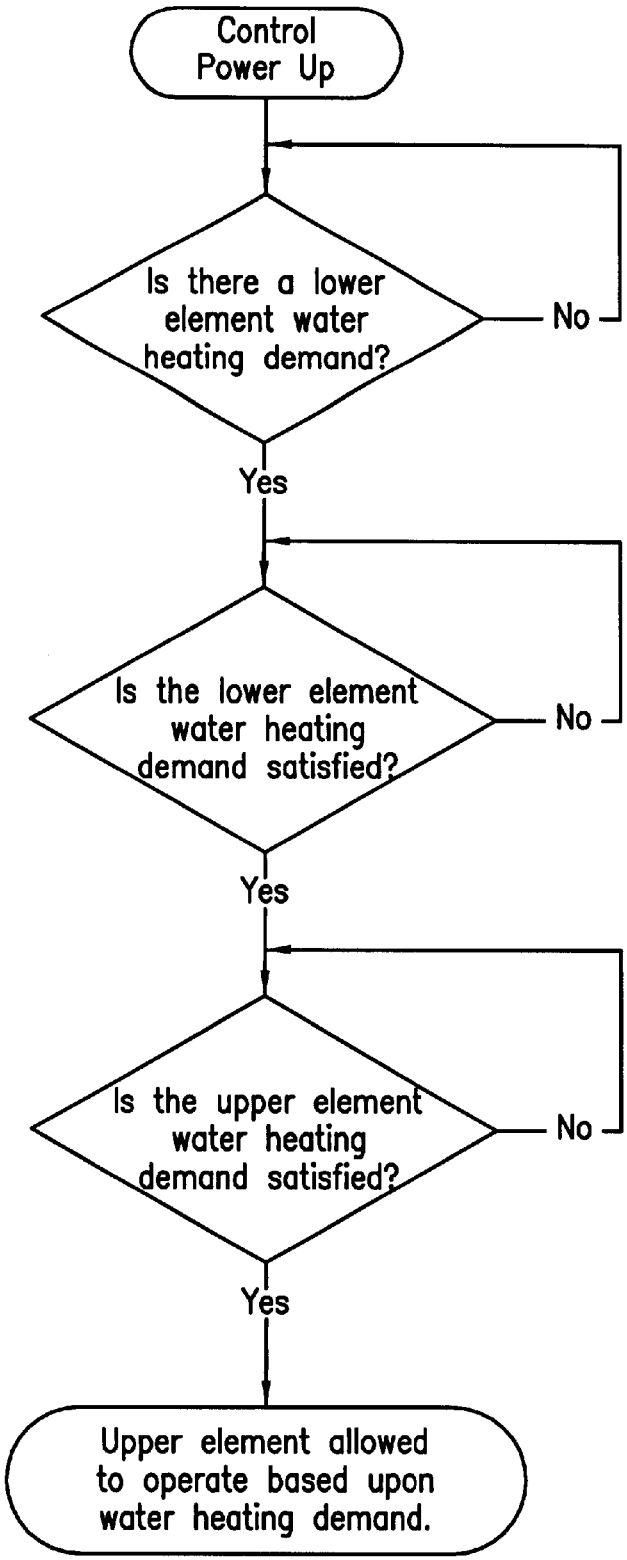
FIG. 8 is a simplified functional block diagram illustrating another embodiment of the function of FIG. 7.

One particular sequence of operational steps to achieve operation of the water heater in this matter is shown in more detail in FIGS. 7 and 8. When the water heater control system is first started, the control electronic circuitry of heater control board 47 records the initial temperature at bottom element 26 and then turns on the bottom element 26 for ten seconds and then off for two minutes. Heater control board 47 then records the file temperature of the bottom element 26 as measured through thermistor 44 and calculates the difference between the final temperature and initial temperature.

If the difference between these temperatures is greater than five degrees, then heater control board 47 turns off both elements 26 through relays 50. Heater control board 47 then checks to see if system power has been turned off or reset through incoming power supply 48. Once the system has been reset, heater control board 47 then begins this process from start.

If, however, the temperature differential is less than five degrees, then heater control board 47 energizes bottom element 26 to heat the water in tank 16 until it reaches the temperature set on temperature adjust dial 42.

If the temperature of temperature adjust dial 42 is less than 110° F., then the top element 26 remains off. Otherwise, heater control board 47 checks the temperature at thermistor 44 in upper element 26. If the temperature of thermistor 44 in upper element 26 is equal to the temperature of dial 42 minus 5° F., then heater control board 47 does not energize upper element 26 until the temperature at thermistor 44 in upper element 26 is less than the turn on temperature (which is typically the temperature set on temperature adjust dial 42 minus some increment such as 5°) minus 5° F. Heater control board 47 then energizes top element 26.

Heating of the water in tank 16 then continues in a conventional manner until the turn off temperature of temperature adjust dial 42 is achieved.

By energizing upper and lower elements 26 in the manner described above, the significant advantages of the invention can be achieved. For example, energizing the element briefly (e.g., about 5–10 seconds) and detecting temperature with a thermistor allows heater control board 47 to prevent elements 26 from being energized for long periods of time in a "dry fire" condition, thereby avoiding substantial degradation of the elements and significantly extending their life.

Thus, the terms "substantially no degradation" refers to little or no element degradation that occurs for an element energization period of about 5 seconds and up to about 10 seconds. Energizing the element for longer than about 10 seconds can result in substantial degradation under dry fire conditions.

Use of thermistor 44 allows for a much more accurate and responsive detection of temperature than the use of more conventional temperature-sensing technology, such as bimetallic strip. This allows the significant temperature changes which occur in a short period of time under a dry fire condition to be detected with only a short (e.g., about 5–10 seconds) energizing of the heating element 26. In this way, a dry fire condition can be detected virtually immediately to prevent overheating of the element, which significantly reduces its useful life.

Also, use of thermistors 44 eliminates the electromechanical thermostats and their associated foaming aprons, fiberglass batts and the like. Small doughnut-shaped foam dams surround the bases 27 and permit foam insulation to cover more surface area of the tank.

An alternative set of operational steps in accordance with the invention is shown in FIG. 8. In this embodiment of the invention, during control power up of the water heater, heater control board 47 checks to see if there is a need for heating of the water at lower element 26 by measuring the temperature at thermistor 44 and comparing the measured temperature with that of temperature adjust dial 42.

If such a demand exists, heater control board 47 energizes lower element 26 and continuously checks to see if the water heating demand is satisfied.

Once this heating demand is satisfied, heater control board 47 then repeats this process for the upper element 26.

The improvements described above result in a highly energy efficient water heater. The result is that the thickness of the foam insulation positioned between tank 16 and jacket 12 can be reduced by up to 50%. In other words, a 2" foaming cavity can be reduced to a 1" cavity, and still retain the same energy input.

Although this invention has been described in connection with specific forms thereof, it will be appreciated that a wide variety of equivalents may be substituted for the specific elements described herein without departing from the spirit of the scope of this invention as described in the appended claims. For example, water tank 16 may be made of a number of sizes and shapes and may be made from a wide variety of materials such as metals and/or plastics. Foam insulation 14 may similarly be made from any number of high energy efficient foam insulations well known in the art.

The bottom of the water tank 16 may have various shapes, either with lower flanges as shown or as a flat construction. Other modifications may be made, including use of foam insulation between the bottom of tank 16 and bottom pan 20. Also, outer jacket 12 may be made from any number of materials such as rolled metals, preferably steel, or extruded vinyl materials and the like. Also, top pan 18 and bottom pan 20 may be deep-drawn, stamped or the like, or be made from metal, plastic or other suitable materials. Various types of heating elements may be utilized so long as they are used in conjunction with thermistor sensors 44.

What is claimed is:

1. An electric water heater comprising:

a water container;

an element positioned to heat water in said water container;

a sensor positioned to sense temperature proximate to said element;

a second element for further heating said water;

a second sensor to sense temperature proximate said second element; and a controller connected to said element, said second element, said sensor and said second sensor, said controller programmed to prevent energizing of said second element unless said element has been previously energized without a subsequent interruption of power to said controller and the temperature of water sensed by said second sensor is greater than or equal to the temperature of water sensed by said sensor.

2. The water heater defined in claim 1 wherein said sensor is a thermistor.

3. The water heater defined in claim 1 wherein said element comprises a base and a resistance heater, and said sensor is embedded in said base.

4. An electric water heater comprising:

a water container;

an element positioned to heat water in said water container;

a sensor positioned to sense temperature proximate said element; and a controller connected to said element and said sensor, said controller preventing substantial degradation of said element by disengaging said element in the event that a sensed temperature difference is greater than a predetermined temperature difference;

a second element located above said element and positioned to heat said water; and a second sensor located to sense temperature proximate said second element, said second element and said second sensor being connected to said controller, wherein the controller prevents energizing of said second element unless said element has been previously energized without a subsequent interruption of power to said controller and the temperature of water sensed by said second sensor is greater than or equal to the temperature of water sensed by said sensor.

5. The water heater defined in claim 4 wherein said controller is capable of energizing said second element when the temperature sensed by said second sensor is less than a predetermined temperature.

6. An electric water heater comprising:

a water container;

an element positioned to heat water in said container;

a second element positioned above said element to heat said water;

a sensor positioned to sense temperature of water in said container;

a second sensor positioned above said sensor to sense temperature proximate said second element; and a controller connected to said element, said second element, said sensor and said second sensor, said controller programmed to 1) compare temperature information received from said sensor would be predetermined temperature and energizing said element based on said comparison, 2) compare temperature information received from said second sensor to a preset temperature and energizing said second element if a sensed temperature is less than a second preset temperature which is less than said preset temperature, 3) deenergize said element and said second element when temperature information received from said sensor and said second sensor reach said preset temperature, and 4) prevent energizing of said second element unless said element has been previously energized without a subsequent interruption of power to said controller and the temperature of water sensed by said second sensor is greater than or equal to the temperature of water sensed by said sensor.

7. The water heater defined in claim 6 wherein said sensor is a thermistor.

8. The water heater defined in claim 6 wherein said element comprises a base and a resistance heater, and said sensor is embedded in said base.

9. The water heater defined in claim 6 wherein said predetermined temperature is variable.

10. The water heater defined in claim 6 wherein said controller is capable of comparing temperature information received from said sensor with a second predetermined temperature and deenergizing said element based on the result thereof.

11. The water heater defined in claim 10 wherein said second predetermined temperature is variable.

12. The water heater defined in claim 6 wherein said controller is capable of comparing temperature information received from said sensor with a third predetermined temperature and engaging a controller lockout based on the result thereof.

13. The water heater defined in claim 12 wherein said controller lockout is disengaged by interrupting and then restoring power to said controller.

14. An electric water heater comprising a water tank;

an element positioned to heat water in said tank;

a thermistor positioned to sense temperature adjacent said element;

a second element positioned to further heat said water;

a second thermistor located to sense temperature proximate said second element;

a controller connected to said element, said thermistor, said second element and said second thermistor, said controller programmed to prevent energizing of said second element unless said element has been previously energized without a subsequent interruption of power to said controller and the temperature of water sensed by said second thermistor is greater than or equal to the temperature of water sensed by said thermistor.

15. The water heater defined in claim 14 wherein said element comprises a base and a resistance heater, and said sensor is embedded in said base.

16. An electric water heater comprising:

a water tank;

an element positioned to heat water in said water tank;

a thermistor positioned to sense temperature adjacent said element; and a controller connected to said element and said thermistor, said controller being capable of comparing temperature information received from said thermistor with a predetermined temperature and energizing said element when said sensed temperature is less than said predetermined temperature, and said controller preventing substantial degradation of said element by deenergizing said element in the event that a sensed temperature different is greater than a predetermined temperature difference;

a second element located above said element and positioned to heat said water; and a second sensor located to sense temperature proximate said second element, said second element and said second sensor being connected to said controller, wherein the controller prevents energizing of said second element unless said element has been previously energized without a subsequent interruption of power to said controller and the temperature of water sensed by said second sensor in greater than or equal to the temperature of water sensed by said sensor.

17. The water heater defined in claim 16 wherein said controller is capable of energizing said second element when the temperature sensed by said second sensor is less than a predetermined temperature.

18. The water heater defined in claim 14 wherein said predetermined temperature is variable.

19. The water heater defined in claim 14 wherein said controller is capable of comparing temperature information received from said sensor with a second predetermined temperature and deenergizing said element based on the result thereof.

20. The water heater defined in claim 19 wherein said second predetermined temperature is variable.

21. The water heater defined in claim 14 wherein said controller is capable of comparing temperature information received from said sensor with a third predetermined temperature and engaging a controller lockout based on the result thereof.

22. The water heater defined in claim 21 wherein said controller lockout is disengaged by interrupting and then restoring power to said controller.

* * * * *